US011597561B2

(12) United States Patent
Smith

(10) Patent No.: US 11,597,561 B2
(45) Date of Patent: Mar. 7, 2023

(54) COMPOUND BOTTLES

(71) Applicant: Kenton Oliver Smith, Ulvenhout (NL)

(72) Inventor: Kenton Oliver Smith, Ulvenhout (NL)

( * ) Notice: Subject to any disclaimer, the term of this patent is extended or adjusted under 35 U.S.C. 154(b) by 0 days.

(21) Appl. No.: 17/384,288

(22) Filed: Jul. 23, 2021

(65) Prior Publication Data

US 2022/0041332 A1 Feb. 10, 2022

Related U.S. Application Data

(60) Provisional application No. 63/062,143, filed on Aug. 6, 2020.

(51) Int. Cl.

| | |
|---|---|
| ***B65D 21/02*** | (2006.01) |
| ***B65D 41/04*** | (2006.01) |
| ***B65D 43/02*** | (2006.01) |
| ***B65D 85/72*** | (2006.01) |

(52) U.S. Cl.

CPC ..... *B65D 21/0233* (2013.01); *B65D 41/04* (2013.01); *B65D 43/0212* (2013.01); *B65D 85/72* (2013.01)

(58) Field of Classification Search

CPC ..... B65D 21/0233; B65D 41/04; B65D 43/0212; B65D 85/72; B65D 21/0234; B65D 21/04; B65D 21/06; B65D 21/064; B65D 21/02; A45F 3/16

USPC ..... 206/515

See application file for complete search history.

(56) References Cited

U.S. PATENT DOCUMENTS

| | | | | |
|---|---|---|---|---|
| 9,950,827 | B1 * | 4/2018 | Lau | B65D 23/001 |
| 2020/0047948 | A1 * | 2/2020 | Zitron | B65D 25/42 |

FOREIGN PATENT DOCUMENTS

| | | | | |
|---|---|---|---|---|
| CN | 203524367 | U * | 4/2014 | |
| CN | 106388232 | A * | 2/2017 | |
| CN | 109077570 | A * | 12/2018 | A47G 19/2255 |
| KR | 20150076483 | A * | 7/2015 | |
| KR | 101674676 | B1 * | 11/2016 | |

* cited by examiner

*Primary Examiner* — John K Fristoe, Jr.
*Assistant Examiner* — Laura E. Parker
(74) *Attorney, Agent, or Firm* — Carter, DeLuca & Farrell LLP; David C. Lee, Esq.

(57) ABSTRACT

An apparatus includes an exterior portion, an interior portion, a first top, and a second top. The exterior portion includes an exterior wall, an exterior top end coupled to the exterior wall, and an exterior bottom closed end coupled to the exterior wall. The interior portion nests within the exterior portion and includes an interior wall having a geometry smaller than the exterior portion, an interior bottom closed end coupled to the interior wall, and an interior top end coupled to the interior wall opposite the interior bottom closed end. The first top closes the interior top end to form an interior space within the interior portion. The first top includes a first opening. The second top includes a second opening. The second top engages with the exterior bottom end in a stored position and engages with the exterior top end in a containing position.

18 Claims, 9 Drawing Sheets

COMPOUND BOTTLES

CROSS-REFERENCE TO RELATED APPLICATIONS

The present application claims the benefit of U.S. Provisional Patent Application No. 63/062,143 entitled "Bottle for Containing a Potable Liquid", filed on 6-Aug.-2020. The entire contents of the above-listed application are hereby incorporated by reference for all purposes.

BACKGROUND

It is recommended that a person drink at least 1.5 L of water a day. Many types of bottles exist to facilitate such a daily intake of water. However, such bottles are often very large and cumbersome to store or take on the go. Furthermore, such bottles often do not allow for hygienic sharing of water between persons, thereby encouraging transfer of germs and bacteria when shared.

BRIEF DESCRIPTION OF THE DRAWINGS

The present description will be understood more fully when viewed in conjunction with the accompanying drawings of various examples of compound bottles. The description is not meant to limit the compound bottles to the specific examples. Rather, the specific examples depicted and described are provided for explanation and understanding of compound bottles. Throughout the description the drawings may be referred to as drawings, figures, and/or FIGs.]

DETAILED DESCRIPTION

Compound bottles, as disclosed herein, will become better understood through a review of the following detailed description in conjunction with the figures. The detailed description and figures provide merely examples of the various embodiments of compound bottles. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional disposable water bottle may include a thin unified body with a single cap disposed at an opening or spout of the bottle. Conventional reusable water bottles may include a rigid body with a lid and a corresponding cap.

However, conventional systems do not offer the ability to carry multiple bottles in a compound or nested arrangement. Conventional systems require additional space if additional bottles are to be carried or stored. This consumes a relatively high amount of space and becomes difficult to carry multiple bottles to support multiple users or provide structure to carry multiple fluids.

Implementations of compound bottles described herein may address some or all of the problems described above. A compound bottle may include an interior portion compatible to be inserted into an exterior portion and to secure the interior portion with the exterior portion to reduce an overall package size of the compound bottle. Tops couple to ends of the joined interior and exterior portion to facilitate carriage and storage. The compound bottle may function as a single bottle in a compound arrangement and separate to form two independent bottles.

Figure 1:
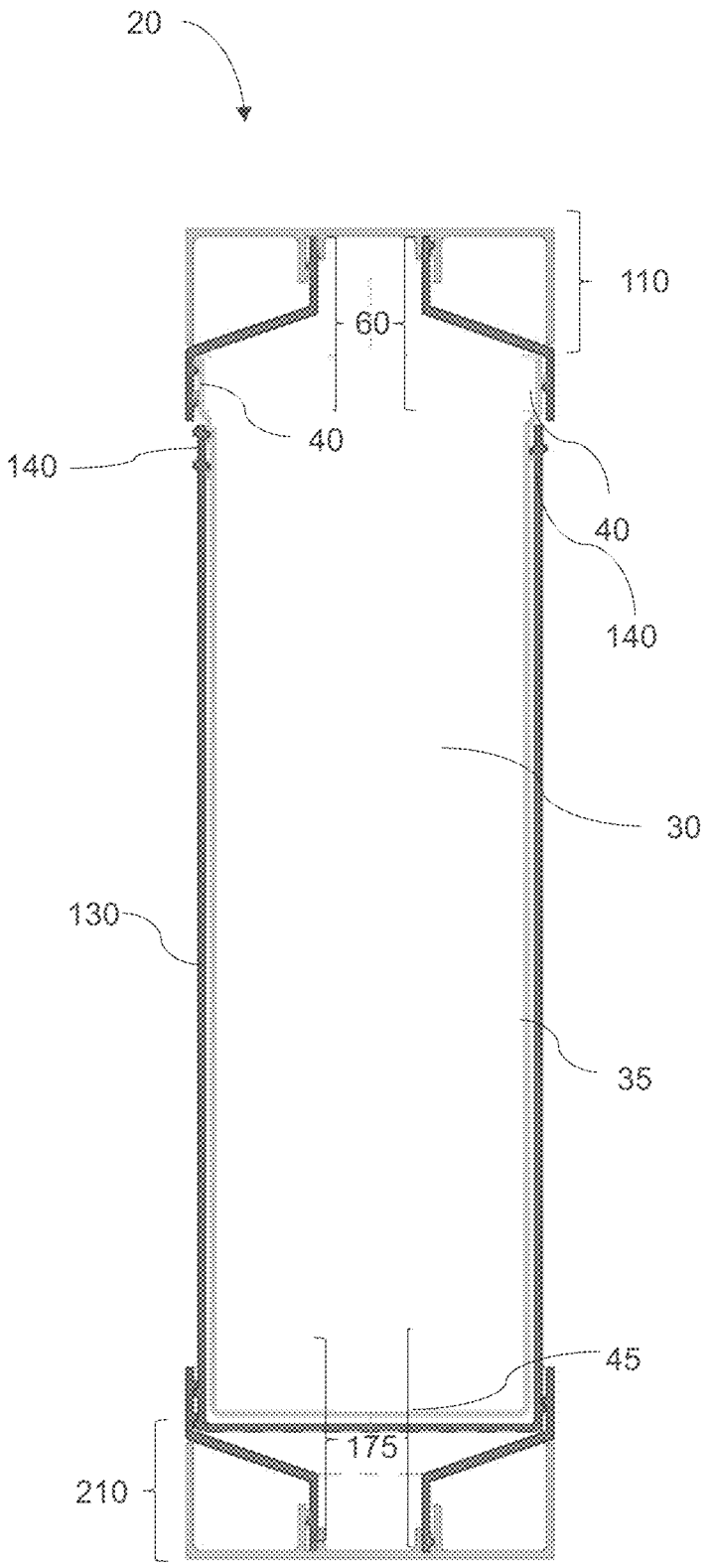
FIG. 1 is a schematic diagram of a compound bottle, according to an embodiment.

FIG. 1 is a schematic diagram of a compound bottle, according to an embodiment. Embodiments of the compound bottle provide a compact arrangement of multiple bottles needing the space of a single bottle for storage and carriage.

In some embodiments, the compound bottle 20 is a compound container configured to contain a liquid. For example, the compound bottle 20 may be capable of carrying potable water. In some embodiments, the compound bottle 20 may include an interior portion 25 nestable within an exterior portion 120.

The interior portion 25 may define an interior space 30. The interior portion 25 may include an interior wall 35, an interior top end 40, and a bottom end 45. The interior wall 35 may have an approximately cylindrical geometry extending between the bottom end 45 and the interior top end 40. The interior top end 40 may extend from the interior wall 35 to form an opening in an end of the interior portion 25. The bottom end 45 may form a closed end of the interior portion 25 opposite the interior top end 40. In some embodiments, the interior portion may have a volume between 0.6375 liters and 1.0 liters. In other embodiments, the interior portion 25 has a volume of approximately 0.75 liters. In some embodiments, the interior portion 25 may have more or less volume.

In some embodiments, the compound bottle 20 includes a first top 60. In some embodiments, the first top 60 is sized for placement at an opening 50 formed in the interior top end 40 of the interior portion 25. In some embodiments, the first top 60 couples to the interior portion 25 to form a leak resistant joining. The first top 60 and the interior portion 25 may include a seal, gasket, or so forth to resist leaking. In some embodiments, the first top 60 and the interior portion 25 may be secured to one another via threads, lips, clips, magnets, friction fit, or so forth.

In some embodiments, the interior portion 25 may nest into the exterior portion 120. The exterior portion 120 may couple to the interior portion 25 via threads, clips, or other connections. In some embodiments, the interior portion 25 may be sized to form a gap between the interior portion 25 and the exterior portion 120. The gap may extend around the side walls of the interior portion 25 and may extend across the bottom end 45 of the interior portion 25.

In some embodiments, the exterior portion 120 may include a second cap 175 attached to a bottom end of the exterior portion 120. The second cap 175 may be coupled to threads or other structures positioned proximate the bottom end of the exterior portion 120. The second cap 175 may be sized to couple to the bottom end of the exterior portion 120 and to the opening of the exterior portion 120 and/or the interior top end 40 of the interior portion 25.

Figure 2:
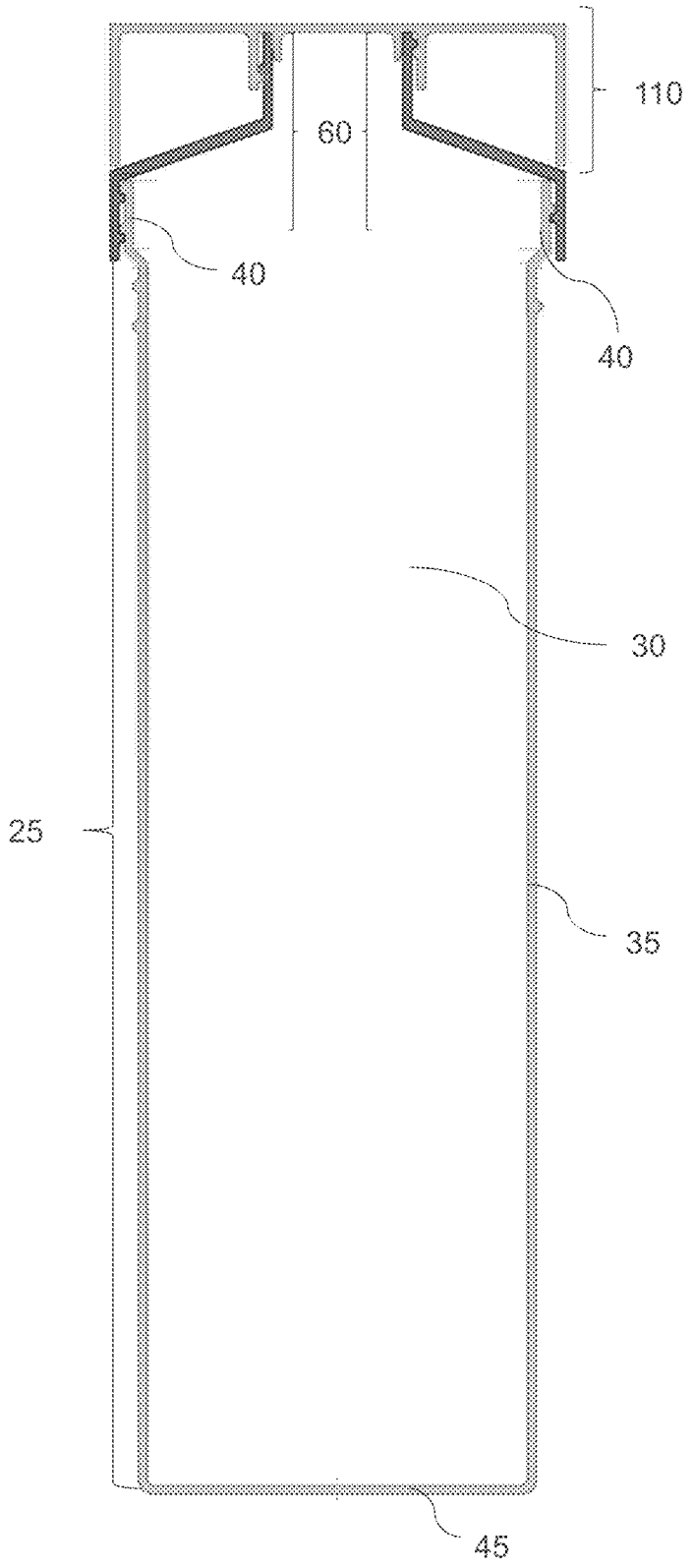
FIG. 2 is a schematic diagram of an interior portion of the compound bottle of FIG. 1 with a first top, according to an embodiment.

FIG. 2 is a schematic diagram of an interior portion 25 of the compound bottle 20 of FIG. 1 with a first top 60, according to an embodiment. Embodiments may provide a versatile multi-bottle system with interchangeable parts.

In some embodiments, the interior portion 25 is compatible with the first top 60 to fit the first top 60 to form a water container. The interior top end 40 is formed in the interior portion 25 to be opposite the bottom end 45. The interior top end 40 may interface with the first top 60. In some embodiments, the first top 60 has a geometry matching a geometry of the interior portion 25 at the interior top end 40. In some embodiments, the combination of the interior portion 25 and the first top 60 forms a water container with the exterior portion 120 in place on the interior portion 25 or with the exterior portion 120 removed.

Figure 3:
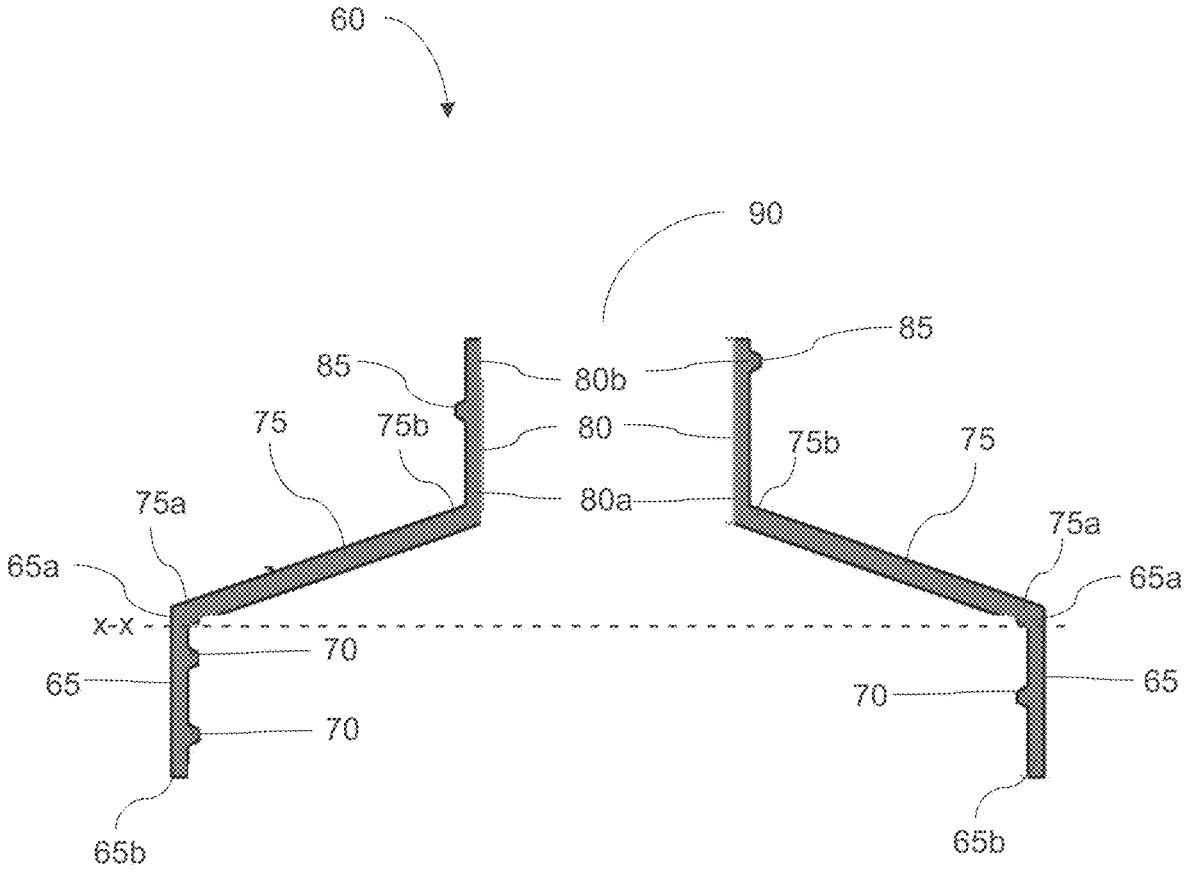
FIG. 3 is a schematic diagram of a first top of FIG. 2, according to an embodiment.

FIG. 3 is a schematic diagram of a first top 60 of FIG. 2, according to an embodiment. Embodiments may provide a flexible top for covering a compound bottle 20.

In some embodiments, the first top 60 includes a first vertical segment 65 extending downward around the interior top end 40. In some embodiments, the first vertical segment 65 has corresponding sixth threads 70 for mating with a of fifth thread 55 of the interior top end 40. The number of the sixth threads 70 may be the same or different for the first vertical segment 65 and the interior top end 40. The first vertical segment 65 may have a first end 65*a* and a second end 65*b*. The first end 65*a* may be flush with the opening 50 of the interior top end 40. The second end 65*b* may extent to, or just short of, the exterior wall 35 of the interior portion 25. An angled segment 75 may extend upward from the first vertical segment 65 and inward. The angled segment 75 may be disposed at an angle of 15° to 25° with respect to a horizontal axis x-x. The angled segment 75 may have a first end 75*a* and a second end 75*b*. The first end 75*a* may leads from the first end 65*a* of the first vertical segment. The second end 75*b* may be coupled to a second vertical segment 80. The second vertical segment 80 may have a first end 80*a* that extends upward from the angled segment 75 and may terminate with a second end 80*b*. The second vertical segment 80 may include one or more threads 85. The first top 60 also includes an opening 90 formed by the second vertical segment 80. In some embodiments, the first vertical segment 65, the second vertical segment 80, and the angled segment 75 are coaxial.

In some embodiments, the components of the first top 60 may have a uniform thickness. In other embodiments, one or more of the components of the first top 60 may have different thicknesses. In some embodiments, the thickness of one or more of the components of the first top 60 may vary along a length of position on the respective component. In some embodiments, the first top 60 is a single unified structure. In other embodiments, the first top 60 may be composed of multiple components that are joined mechanically, chemically, or otherwise to form the first top 60.

In some embodiments, the first top 60 may be constructed of a plastic, metal, composite, or other synthetic or natural material or combination of synthetic and/or natural materials. The first top 60 may be constructed by printing, molding, extruding, milling, or so forth.

Figure 4:
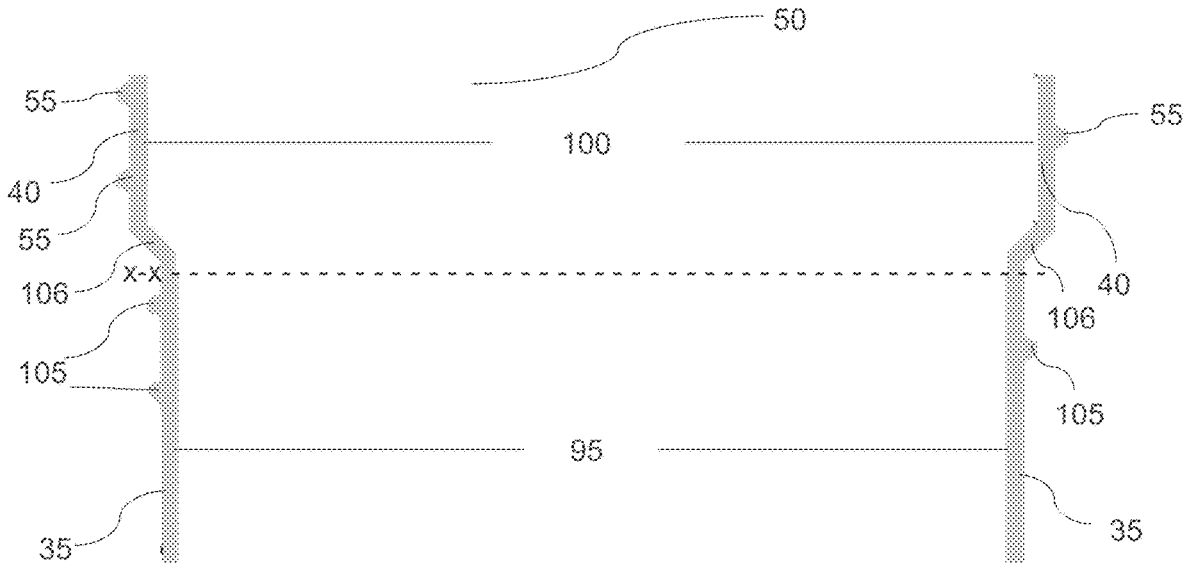
FIG. 4 is a schematic diagram of a top end of the interior portion, according to an embodiment.

FIG. 4 is a schematic diagram of an interior top end 40 of the interior portion 25, according to an embodiment. Embodiments may provide a compound bottle 20 having an interior top end 40 which facilitates the nesting of multiple water storage portions.

In some embodiments. the exterior wall 35 of the interior portion 25 has a diameter 95 that is narrower than a diameter 100 of the interior top end 40 of the interior portion 25. In some embodiments, the diameter 95 of the exterior wall 35 ranges between 59.5 mm and 80.5 mm. In other embodiments, the diameter 100 of the interior top end 40 ranges between 68 mm and 92 mm. Furthermore, the exterior wall 35 may include fourth thread 105. A transition segment 106 may be included which extend upward and outward from the exterior wall 35 to the interior top end 40. The transition segment 106 may be disposed at an angle ranging from 15° to 25° with respect to the horizontal axis x-x. The interior top end 40 includes the opening 50 and may further include the fifth thread 55, with which the sixth threads 70 of the first vertical segment 65 of the first top 60 may be aligned to mate.

Figure 5:
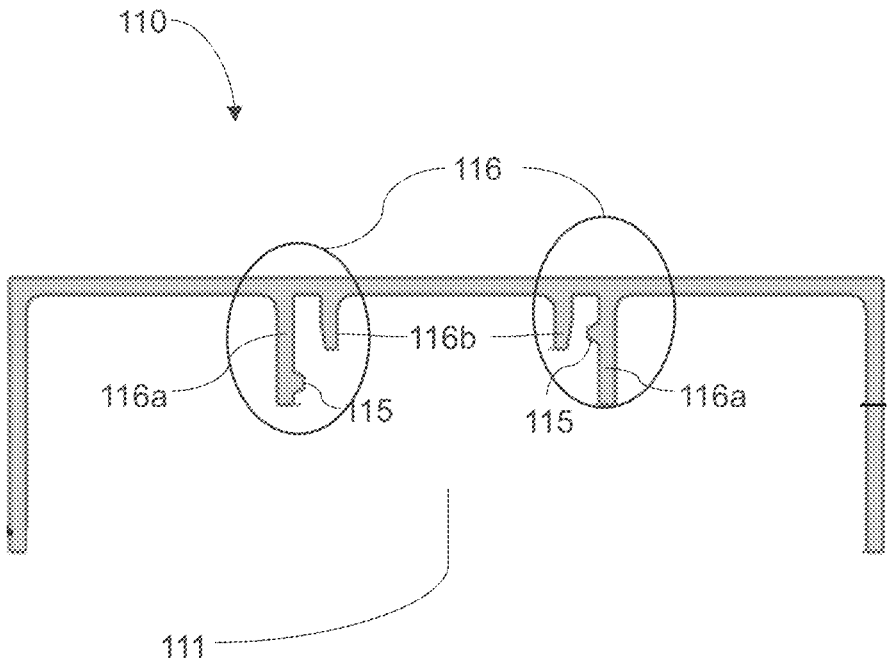
FIG. 5 is a schematic diagram of a first cap of the first top of FIG. 2, according to an embodiment.

FIG. 5 is a schematic diagram of a first cap 110 of the first top 60 of FIG. 2, according to an embodiment. Embodiments may provide an intuitive and decipherable system for nesting bottles to reduce package size and provide flexibility.

In some embodiments, the compound bottle 20 includes a first cap 110 for placement over the first top 60. the first cap 110 may include an interior space 111 with threads 115 for mating with the at least one thread 85 of the second vertical segment 80 of the first top 60. In some embodiments, the thread 115 is located on an interior vertical segment 116 extending downward within the interior space 111 of the first cap 110, along the second vertical segment 80. In some embodiments, the interior vertical segment 116 includes a first segment 116*a* and a second segment 116*b*. The second vertical segments 80 of the first top 60 may be positioned within the first segment 116*a* and second segment 116*b*. In some embodiments, the first segment 116*a* is longer than the second segment 116*b*. The first cap 110 may extend downward on the periphery to be flush with the first end 65*a* of the first vertical segments of the first top 60.

In some embodiments, the first cap 110 may be constructed of a similar or disparate material from the first top 60. In some embodiments, the first cap 110 may include an insulating material. The insulating material may make up a portion or an entirety of the first cap 110. For example, an insulating material may be applied to an exterior or interior of the first cap 110, may be incorporated into a layer of the first cap 110, may make up the entire first cap 110, or may be a removable or nonremovable component of the first cap 110.

In some embodiments, the first cap 110 may include a sealing element to resist leaking or seepage. The sealing element may be disposed in the first cap 110 at or near the first segment 116 to interface with the opening 90 of the compound bottle 20. The sealing element may take the form of a gasket, O-ring, washer, or so forth.

Figure 6:
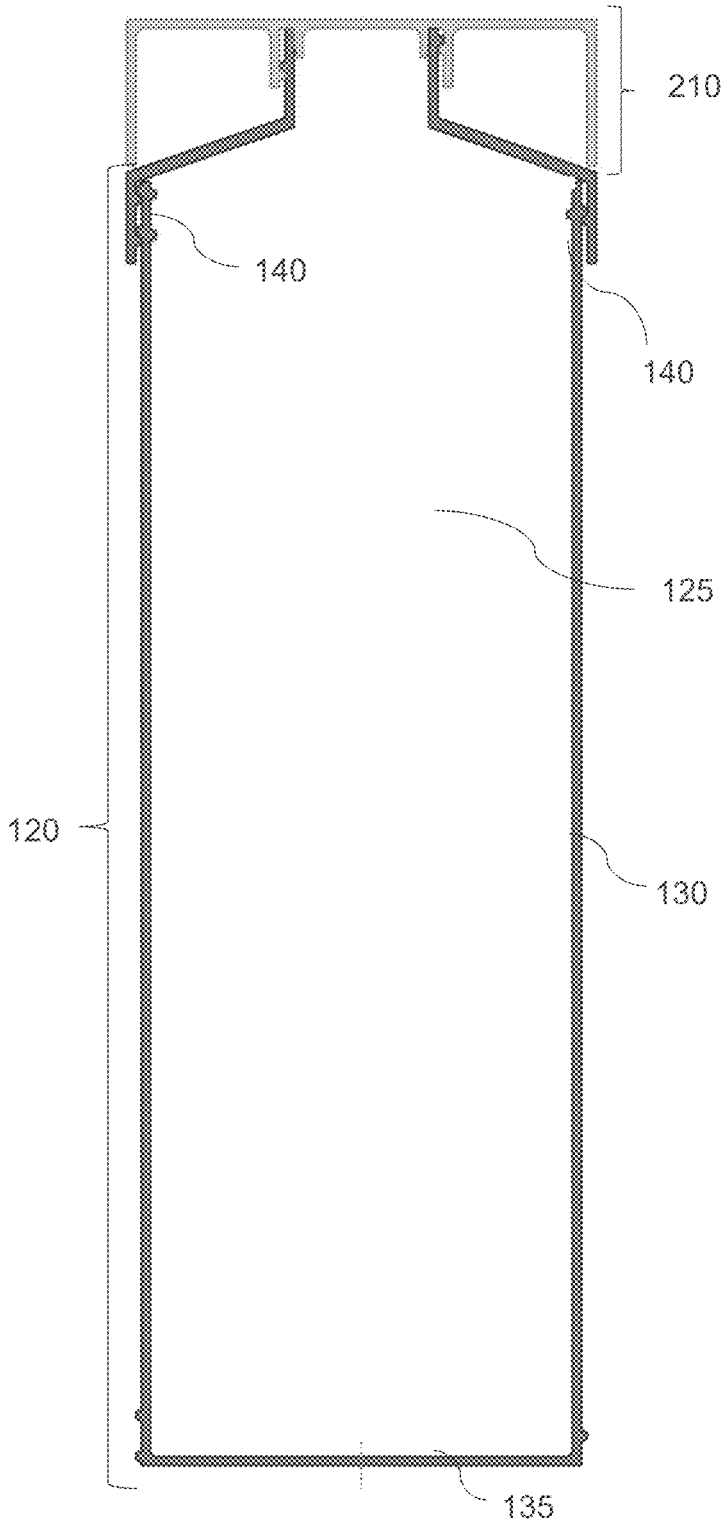
FIG. 6 is a schematic diagram of an exterior portion of the bottle of FIG. 1 with a second top, according to an embodiment.

FIG. 6 is a schematic diagram of an exterior portion of the bottle of FIG. 1 with a second top, according to an embodiment. Embodiments may provide a system which requires the storage space of a single bottle while providing the liquid capacity of multiple bottles.

The exterior portion 120 may include an exterior wall 130, an exterior bottom closed end 135, and an exterior top end 140. The exterior portion 120 may form an interior space 125. In some embodiments, the interior space 125 of the exterior portion 120 may allow for holding a liquid. The size of the exterior top end 140 may allow for insertion of the interior portion 25, with the interior bottom closed end 45 of the interior portion 25 adjacent the exterior bottom closed end 135 of the exterior portion 120. The exterior top end 140 of the exterior portion 120 includes an opening 145.

In some embodiments, the exterior portion 120 has a volume ranging from 0.6375 L to 0.8625 L. In other embodiments, the exterior portion 120 has a volume of 0.75 L. In some embodiments, the exterior portion 120 is form-fitted around the interior portion 25.

In some embodiments, the exterior wall 130 of the exterior portion 120 has a diameter 150 ranging from 61.2 mm to 82.8 mm. The exterior top end 140 of the exterior portion 120 may have a diameter 155 ranging from 61.2 mm to 82.8 mm. In some embodiments, the geometry of the exterior portion 120 may be greater or less than the examples provided herein.

In some embodiments, the fitment of the exterior portion 120 with the interior portion 25 may form an insulating layer. The insulating layer may be formed with air disposed between the interior portion 25 and the exterior portion 120. In some embodiments, the insulating layer may be a separate material or void disposed in the interior portion 25 and/or the exterior portion 120. In some embodiments, the insulating layer may be removable or may be non-removably disposed in one or both of the interior portion 25 and the exterior portion 120.

Figure 7:
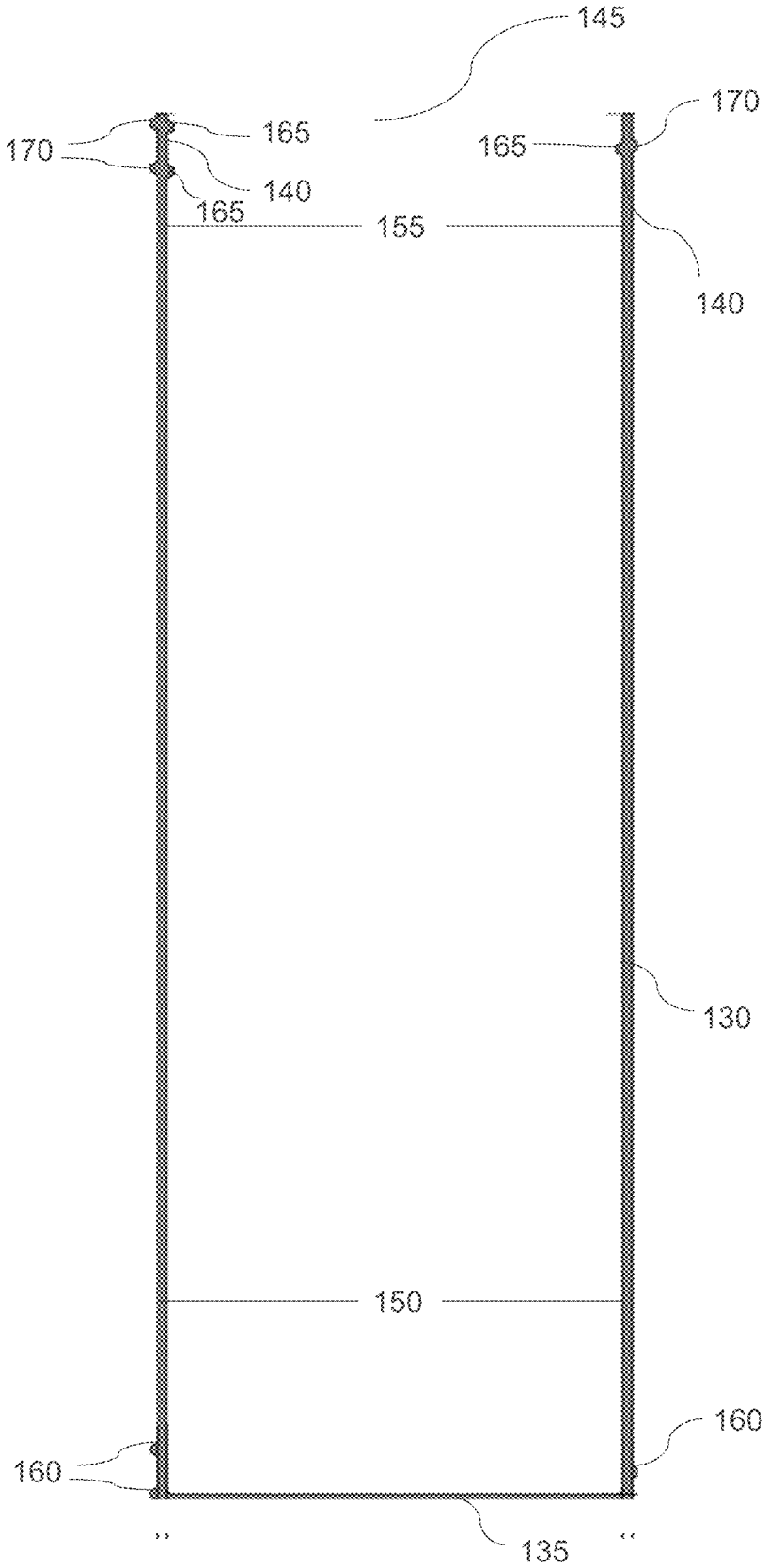
FIG. 7 is a schematic diagram of the exterior portion of FIG. 6, according to an embodiment.

FIG. 7 is a schematic diagram of the exterior portion of FIG. 6, according to an embodiment. Embodiments may provide an intuitive system for nesting the compound bottle 20 to reduce package size and provide flexibility in use and deployment.

In some embodiments, a diameter 150 of the exterior wall 130 of the exterior portion 120 may be equal to the diameter 155 of the exterior top end 140 of the exterior portion 120. The exterior wall 130 of the exterior portion 120 may include third thread 160 disposed near the exterior bottom closed end 135 of the exterior portion 120. The top end of 140 the exterior portion 120 may include interior second threads 165 for mating with the fourth thread 105 of the exterior wall 35 of the interior portion 25, as well as exterior first thread 170.

Figure 8:
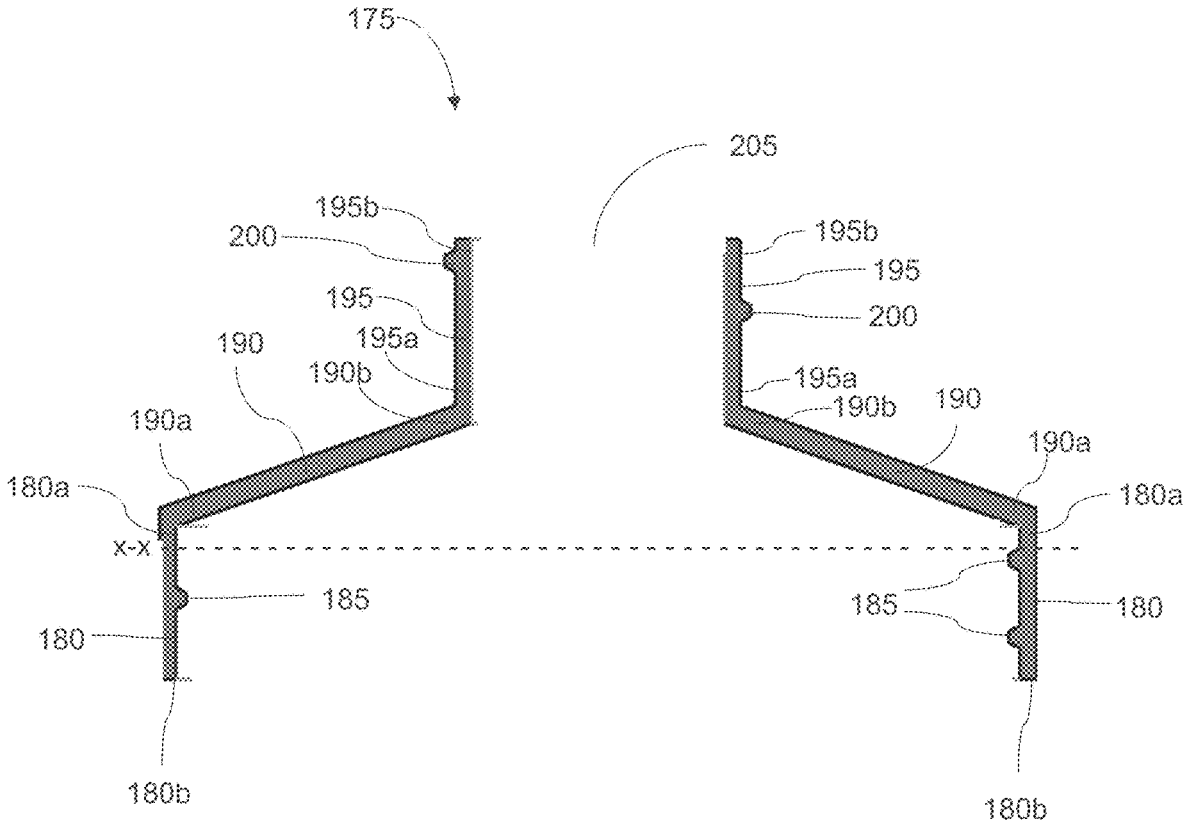
FIG. 8 is a schematic diagram of a second cap of the second top of FIG. 6, according to an embodiment.

FIG. 8 is a schematic diagram of a second cap of the second top of FIG. 6, according to an embodiment. Embodiments may provide a bottle system with interchangeable tops and caps.

In some embodiments, the compound bottle 20 may include a second top 175. The second top 175 may be placed around the exterior bottom closed end 135 of the exterior portion 120 while the interior portion 25 may be within the interior space 125 of the exterior portion 120 in a stored position. The second top 175 may be placed around the exterior top end 140 of the exterior portion 120 while the interior portion 25 may be removed from the interior space 125 of the exterior portion 120 to allow for a liquid to be stored within the interior space 125 of the exterior portion 120 in a containing position. In some embodiments, the second top 175 includes first vertical segment 180 extending downward. The first vertical segment 180 may include a corresponding thread 185 for mating with one or both of the third thread 160 towards the exterior bottom closed end 135 of the exterior portion 120 and the first thread 170 of the exterior top end 140 of the exterior portion 120. The number of third thread 160 on either side of the exterior bottom closed end 135 may be the same or different. In some embodiments, the number of third thread 160 corresponds to the number of eighth thread 185 of the first vertical segment 180 and/or the number of exterior first thread 170 of the exterior top end 140. Alternatively, the eighth thread 185 may be threads for mating with a corresponding thread (in place of the third thread 160) towards the exterior bottom closed end 135 while the exterior portion 120 is not in use for the potable liquid, and for mating with a corresponding thread (in place of the exterior first thread 170) of the exterior top end 140 while the exterior portion 120 is in use for the potable liquid. The first vertical segment 180 may have a first end 180*a* and a second end 180*b*. The first end 180*a* may be flush with the opening 145 of the exterior top end 140 of the exterior portion 120. The second end 180*b* may stop along a portion of the exterior wall of the exterior portion 120. An opposing oblique segment 190 may extend upward from the first vertical segment 180 and together. The opposing oblique segment 190 may be disposed at an angle ranging from 15° to 25° with respect to the horizontal axis x-x. The opposing oblique segment 190 may have a first end 190*a* and a second end 190*b*. The first end 190*a* may lead from the first end 180*a* of the first vertical segment 180. The second end 190*b* segues into a second vertical segment 195. The second vertical segments 195 may have a first end 195*a* that extends upward from the opposing oblique segments 190 and terminates at a second end 195*b*. The second vertical segments 195 may include at least one thread 200. The second top 175 may include an opening 205 within the second vertical segment 195.

Figure 9:
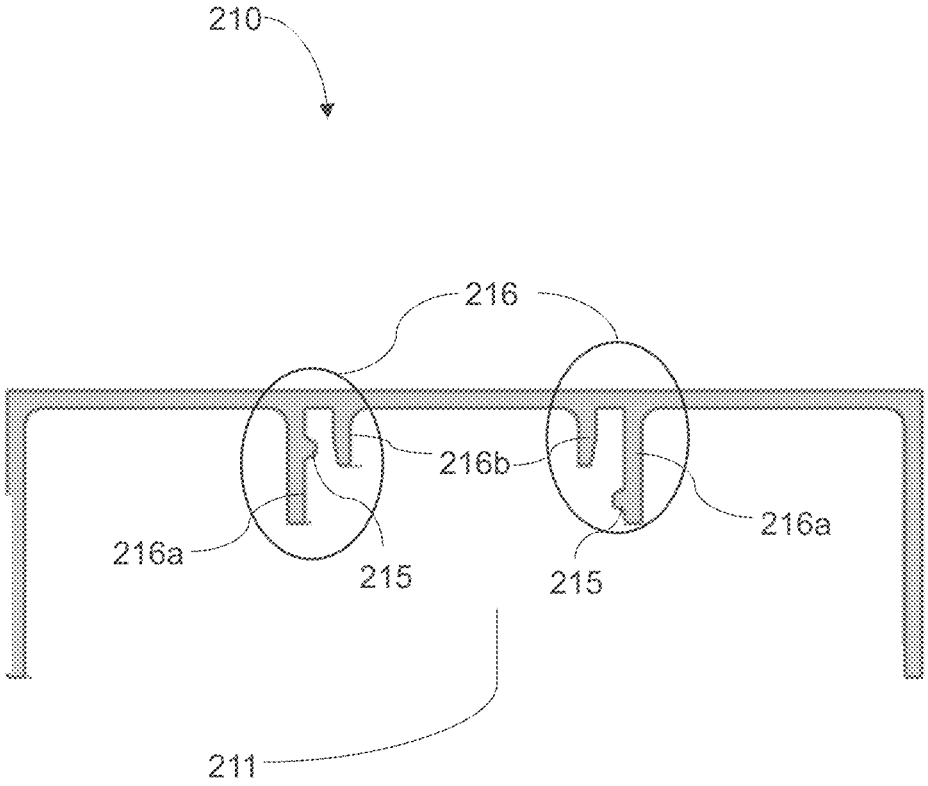
FIG. 9 is a schematic of a second cap of the second top of FIG. 6, according to an exemplary embodiment.

FIG. 9 is a schematic of a second cap of the second top of FIG. 6, according to an exemplary embodiment. Embodiments may provide a secure closure for containing a fluid and provide structure for accessing the fluid within the compound bottle 20.

In some embodiments, the compound bottle 20 includes a second cap 210 for placement over the second top 175. The second cap 210 may form an interior space 211 and may include one or more threads 215 for mating with a thread 200 of the second vertical segment 195 of the second top 175. The threads 200 may be aligned with or staggered from each other. The threads 215 may be likewise aligned with or staggered from each other. In some embodiments, the thread 215 is located on an interior vertical segment 216 extending downward within the interior space 211 of the second cap 210, along the second vertical segment 195. In some embodiments, the interior vertical segment 216 includes a first segment 216*a* and a second segment 216*b*. The second vertical segment 195 may be insertable between a respective first segment 216*a* and a second segment 216*b*. In some embodiments, the first segment 216*a* is longer than the second segment 216*b*. The second cap 210 may be flush with the first end 180*a* of the first vertical segments 180 of the second top 175.

In some embodiments, the interior portion 25 has a length ranging between 195.5 mm and 264.5 mm. A diameter 95 of the exterior wall 35 of the interior portion 25 may range between 59.5 mm and 80.5 mm. The exterior wall 35 may have a thickness ranging between 1.275 mm and 1.725 mm. The exterior wall 35 may have a length ranging between 182.75 mm and 247.25 mm. The interior space 30 may have a diameter ranging between 56.95 mm and 77.05 mm. The interior top end 40 may have a length ranging between 12.75 mm and 17.25 mm. The transition segments 106 may extend along a vertical length ranging between 2.125 mm and 2.875 mm.

In other embodiments, the interior portion 25 has a length of 230 mm. The diameter 95 of the exterior wall 35 of the interior portion 25 may be 70 mm. The exterior wall 35 may have a thickness of 1.5 mm. The exterior wall 35 may have a length of 215 mm. The interior space 30 may have a diameter of 67 mm. The interior top end 40 may have a length of 15 mm. The transition segments 106 may extend along a vertical length of 2.5 mm.

In some embodiments, the first cap 110 and the second cap 210 each have a diameter ranging between 68 mm and 92 mm. The first cap 110 and the second cap 210 may each have a thickness ranging between 1.275 mm and 1.725 mm. The first cap 110 and the second cap 210 may each extend vertically within a range between 21.165 mm and 28.635 mm. The interior spaces 111 and 211 may each have a diameter ranging between 65.45 mm and 88.55 mm. The first segments 116*a* and 216*a* of the interior vertical segments 116 and 216 may each have a length ranging from 9.775 mm and 13.225 mm.

In some embodiments, the first cap 110 and the second cap 210 each have a diameter of 80 mm. The first cap 110 and the second cap 210 may each have a thickness of 1.5 mm. The first cap 110 and the second cap 210 may each extend vertically 24.9 mm. The interior spaces 111 and 211 may each have a diameter of 77 mm. The first segments 116*a* and 216*a* of the interior vertical segments 116 and 216 may each have a length of 11.5 mm.

In some embodiments, the exterior portion 120 has a length ranging between 185.3 mm and 250.7 mm. The diameter 150 of the exterior wall 130 of the exterior portion 120 may range between 61.2 mm and 82.8 mm. The exterior wall 130 may have a thickness ranging between 1.275 mm and 1.725 mm.

In other embodiments, the exterior portion 120 has a length of 218 mm. The diameter 150 of the exterior wall 130 of the exterior portion 120 may be 72 mm. The exterior wall 130 may have a thickness of 1.5 mm.

In some embodiments of the first top 60 and the second top 175 respectively, the first vertical segments 65, 180 have a length ranging between 13.175 mm and 17.825 mm. The oblique segments 75, 190 may have a length ranging between 7.905 mm and 10.695 mm. The second opposing vertical segments 80, 195 may have a length ranging between 12.835 mm and 17.365 mm.

In some embodiments of the first top 60 and the second top 175 respectively, the first opposing vertical segments 65, 180 may have a length of 15.5 mm. The oblique segments 75, 190 may have a length of 9.3 mm. The second vertical segments 80, 195 may have a length of 15.1 mm.

In some embodiments, the various fifth thread 55, 70, 105, 160, 165, 170, 185 may be notches for mating with corresponding threads. The first cap 110 and the second cap 210 may have a thread for mating with a corresponding thread of, respectively, the first top 60 and the second top 175.

The compound bottle 20 may be made from a material that is both durable and dishwasher safe. The compound bottle 20 may be made from metal (e.g., steel, aluminum) or a hard, reusable plastic (e.g., HDPE, PP), or a combination thereof. This may allow the compound bottle 20 to be reusable, and thus environmentally friendly. In some embodiments, one person can drink from the interior portion 25, while a second person can drink from the exterior portion 120. This may allow for hygienic sharing of the compound bottle 20. If one person alone drinks from both the interior portion 25 and the exterior portion 120, they obtain the full volume of the bottle 20, which in one instance ranges between 1.275 L and 1.725 L, and in a more specific instance is 1.5 L. The compact design of the bottle 20 allows for saving space during storage and while in transit.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e., methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively inclusive elements does not preclude other examples that include various combinations of some or all of the alternatively inclusive elements. An example described using a list of alternatively inclusive elements includes at least one element of the listed elements. However, an example described using a list of alternatively inclusive elements does not preclude another example that includes all of the listed elements. And an example described using a list of alternatively inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list. Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples. Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower, or equal in scope to the original claims, are to be considered within the subject matter of the examples described herein.

The invention claimed is:

1. A system comprising:

an exterior portion comprising:
- an exterior wall having a cylindrical geometry;
- an exterior top end coupled to the exterior wall and comprising:
  - a first thread disposed on an outside of the exterior top end; and
  - a second thread disposed on an inside of the exterior top end; and
- an exterior bottom closed end coupled to the exterior wall to close an end of the exterior wall opposite the exterior top end and comprising:
  - a third thread disposed on an outside of the exterior bottom closed end;

an interior portion configured to nest within the exterior portion, wherein the interior portion comprises:
- an interior wall having a cylindrical geometry;
- a fourth thread disposed on an outside of the interior wall to interface with the second thread inside the exterior top end of the exterior portion;
- an interior bottom closed end coupled to the interior wall to close an end of the interior wall; and
- an interior top end coupled to the interior wall to be opposite the interior bottom closed end and comprising:
  - a fifth thread disposed on an outside of the interior top end;

a first top comprising a first opening to allow access to an interior space within the interior portion when engaged with the interior top end of the interior portion or to allow access to an interior space within the exterior portion when engaged with the exterior top end of the exterior portion, the first top further comprising a sixth thread, wherein the first top is configured to be interchangeable with a second top and is configured to:
- engage the sixth thread with the fifth thread on the outside of the interior top end of the interior portion; or
- engage the sixth thread with the third thread on the outside of the exterior bottom closed end of the exterior portion; or
- engage the sixth thread with the first thread on the outside of the exterior top end of the exterior portion; and the second top comprising a second opening to allow access to the interior space within the interior portion when engaged with the interior top end of the interior portion or to allow access to the interior space within the exterior portion when engaged with the exterior top end of the exterior portion, the second top further comprising a seventh thread, wherein the second top is configured to be interchangeable with the first top and is configured to:
- engage the seventh thread with the fifth thread on the outside of the interior top end of the interior portion; or
- engage the seventh thread with the third thread on the outside of the exterior bottom closed end of the exterior portion; or
- engage the seventh thread with the first thread on the outside of the exterior top end of the exterior portion;

a first cap configured to couple to the first top to close the first opening of the first top or to couple to the second top to close the second opening of the second top and configured to be interchangeable with a second cap; and the second cap configured to couple to the second top to close the second opening of the second top or to couple to the first top to close the first opening of the first top and configured to be interchangeable with the first cap.

2. The system of claim 1, wherein the first opening has a diameter less than a diameter of the interior top end of the of the interior portion.

3. The system of claim 1, wherein the first cap is configured to thread onto the first top.

4. The system of claim 1, wherein the interior wall of the interior portion has a diameter less than a diameter of the exterior wall of the exterior portion.

5. The system of claim 1, wherein the interior top end has a diameter greater than a diameter of the interior wall of the interior portion and approximately equal to a diameter of the exterior wall of the exterior portion.

6. The system of claim 1, wherein the fourth thread is disposed on the outside of the interior wall to be proximate the interior top end.

7. An apparatus comprising:

an exterior portion comprising:

an exterior wall having a cylindrical geometry;

an exterior top end coupled to the exterior wall; and an exterior bottom closed end coupled to the exterior wall to close an end of the exterior wall opposite the exterior top end;

an interior portion configured to nest within the exterior portion, wherein the interior portion comprises:

an interior wall having a cylindrical geometry;

an interior bottom closed end coupled to the interior wall to close an end of the interior wall; and an interior top end coupled to the interior wall to be opposite the interior bottom closed end; and a first top configured to close the interior top end of the interior portion to form an interior space within the interior portion, the first top comprising a first opening to allow access to the interior space within the interior portion and allow for disassembly of the interior portion from the exterior portion; and a second top identical to and interchangeable with the first top comprising a second opening, wherein the second top is configured to:

engage with the exterior bottom end of the exterior portion in a stored position; and engage with the exterior top end of the exterior portion in a containing position.

8. The apparatus of claim 7, wherein the first top comprises a first vertical segment and a second vertical segment, wherein the first vertical segment is disposed outward on the first top and the second vertical segment is disposed inward on the first top from the first vertical segment.

9. The apparatus of claim 8, wherein the first top comprises an angled segment extending between the first vertical segment and the second vertical segment, wherein the first vertical segment and the second vertical segment are coaxial.

10. The apparatus of claim 9, further comprising a first cap configured to interface with the first top to close the first opening of the first top and a second cap configured to interface with the second top to close the second opening of the second top.

11. The apparatus of claim 10, wherein at least one of the first cap and the second cap comprises a vertical segment extending into an interior space of the at least one of the first cap and the second cap.

12. The apparatus of claim 11, wherein the vertical segment includes a first segment and a second segment positioned to receive the second vertical segment of the at least one of the first top and the second top.

13. The apparatus of claim 7, wherein the interior top end comprises a transition segment angled between a relatively smaller diameter of the interior wall and a relatively larger diameter of the exterior wall.

14. The apparatus of claim 7, wherein the exterior wall and the interior wall are separated by a gap to insulate contents of the interior portion.

15. The apparatus of claim 7, wherein the exterior bottom closed end and the interior bottom closed end are separated by a gap to insulate contents of the interior portion.

16. The apparatus of claim 7, wherein the interior portion has a volume of between 0.637 liters and 1.0 liters.

17. The apparatus of claim 7, wherein the interior portion has a volume of up to 0.75 liters.

18. A method comprising:

forming an exterior portion comprising:

an exterior wall;

an exterior top end coupled to the exterior wall; and an exterior bottom closed end coupled to the exterior wall to close an end of the exterior wall opposite the exterior top end;

forming an interior portion to nest within the exterior portion and allow for disassembly from the exterior portion when a first top is removed, wherein the interior portion comprises:

an interior wall having a geometry smaller than the exterior portion;

an interior bottom closed end coupled to the interior wall to close an end of the interior wall; and an interior top end coupled to the interior wall to be opposite the interior bottom closed end;

forming the first top to at least partially close the interior top end of the interior portion to form an interior space within the interior portion;

forming a second top comprising a second opening, wherein the second top is configured to:

engage with the exterior bottom end of the exterior portion in a stored position; and engage with the exterior top end of the exterior portion in a containing position;

forming a first cap coupled to the first top to close a first opening of the first top or to open the first opening of the first top to access the exterior or interior portions, whether the interior portion is nested within the exterior portion or the interior portion is disassembled from the exterior portion, wherein the first cap is identical to and interchangeable with a second cap;

forming the second cap coupled to the second top to close the second opening of the second top or to open the second opening of the second top to access the exterior or interior portions, whether the interior portion is nested within the exterior portion or the interior portion is disassembled from the exterior portion, wherein the second cap is identical to and interchangeable with the first cap.

* * * * *